US007986284B2

(12) United States Patent
Moon

(10) Patent No.: US 7,986,284 B2
(45) Date of Patent: Jul. 26, 2011

(54) PLASMA DISPLAY APPARATUS AND METHOD OF DRIVING THE SAME

(75) Inventor: Youngseop Moon, Gumi (KR)

(73) Assignee: LG Electronics Inc., Seoul (KR)

( * ) Notice: Subject to any disclaimer, the term of this patent is extended or adjusted under 35 U.S.C. 154(b) by 956 days.

(21) Appl. No.: 11/871,558

(22) Filed: Oct. 12, 2007

(65) Prior Publication Data

US 2008/0088537 A1 Apr. 17, 2008

(30) Foreign Application Priority Data

Oct. 13, 2006 (KR) ..... 10-2006-0099749

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS 6,340,867 B1 * 1/2002 Kang ..... 315/169.4
6,995,735 B2 * 2/2006 Mizobata ..... 345/60
2002/0008680 A1 * 1/2002 Hashimoto et al. ..... 345/63
2003/0011542 A1 * 1/2003 Nakamura ..... 345/63
2006/0038750 A1 * 2/2006 Inoue et al. ..... 345/60

FOREIGN PATENT DOCUMENTS

EP 1 022 716 A2 7/2000
EP 1 071 069 A2 1/2001
EP 1 209 652 A2 5/2002
JP 11-282415 10/1999
KR 10-2001-0103509 A 11/2001
KR 10-2006-0019807 A 3/2006

OTHER PUBLICATIONS

European Search Report dated Mar. 9, 2010 for Application No. 07 833 323.4.
PCT International Search Report and Written Opinion dated Jan. 21, 2008.

* cited by examiner

*Primary Examiner* — Richard Hjerpe
*Assistant Examiner* — Andrew Schnirel
(74) *Attorney, Agent, or Firm* — Ked & Associates, LLP

(57) ABSTRACT

A plasma display apparatus and a method of driving the same are disclosed. The plasma display apparatus includes a plasma display panel including an address electrode and a data driver. The data driver supplies a rising signal gradually rising from a first voltage to a second voltage during a first sustain period and a falling signal gradually falling from the second voltage to a third voltage during a second sustain period following the first sustain period to the address electrode.

19 Claims, 10 Drawing Sheets

PLASMA DISPLAY APPARATUS AND METHOD OF DRIVING THE SAME

This application claims the benefit of Korean Patent Application No. 10-2006-0099749 filed on Oct. 13, 2006, which is hereby incorporated by reference.

BACKGROUND OF THE DISCLOSURE

1. Field of the Disclosure

This document relates to a plasma display apparatus and a method of driving the same.

2. Description of the Related Art

A plasma display apparatus generally includes a plasma display panel displaying an image and a driver for driving the plasma display panel.

The plasma display panel has the structure in which barrier ribs formed between a front substrate and a rear substrate form a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY OF THE DISCLOSURE

This document provides a plasma display apparatus and a method of driving the same capable of suppressing an opposite discharge and increasing life span of the plasma display apparatus while the generation of bright defects is prevented by supplying a voltage lower than a data voltage to an address electrode during a sustain period.

In one aspect, a plasma display apparatus comprises a plasma display panel including an address electrode, and a data driver that supplies a rising signal gradually rising from a first voltage to a second voltage to the address electrode during a first sustain period and a falling signal gradually falling from the second voltage to a third voltage to the address electrode during a second sustain period following the first sustain period.

In another aspect, a method of driving a plasma display apparatus including an address electrode comprises supplying a rising signal gradually rising from a first voltage to a second voltage to the address electrode during a first sustain period, and supplying a falling signal gradually falling from the second voltage to a third voltage to the address electrode during a second sustain period following the first sustain period.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Embodiments will be described in a more detailed manner with reference to the drawings.

Figure 1:
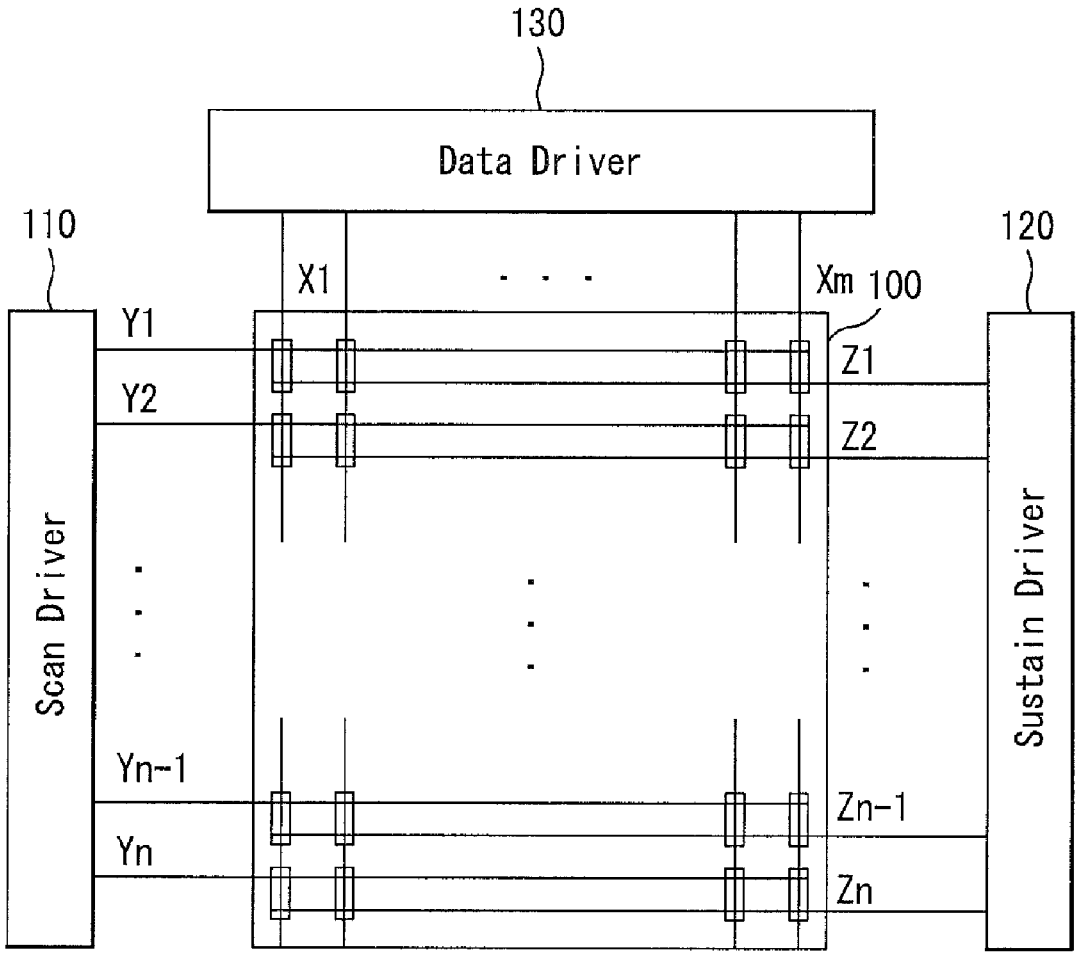
FIG. 1 illustrates a plasma display apparatus according to an exemplary embodiment.

As illustrated in FIG. 1, a plasma display apparatus according to an exemplary embodiment includes a plasma display panel 100, a scan driver 110, a sustain driver 120 and a data driver 130.

The plasma display panel 100 includes scan electrodes Y1 to Yn, sustain electrodes Z, and address electrodes X1 to Xm intersecting the scan electrodes Y1 to Yn and the sustain electrodes Z.

The scan driver 110 supplies driving signals to the scan electrodes Y1 to Yn during the reset period, the address period and the sustain period. For instance, the scan driver 110 may supply at least one of a setup signal or a set-down signal to the scan electrodes Y1 to Yn during the reset period; a scan reference voltage and a scan signal for selecting discharge cells to be turned on to the scan electrodes Y1 to Yn during the address period; and a sustain signal for a discharge to the scan electrodes Y1 to Yn during the sustain period.

During the address period, the scan driver 110 may supply a scan bias voltage equal to a sum of the scan reference voltage and a lowest voltage of the scan signal to the scan electrodes Y1 to Yn instead of the scan reference voltage.

The sustain driver 120 supplies driving signals to the sustain electrodes z during the sustain period. For instance, the sustain driver 120 may supply a sustain signal to the sustain electrodes Z during the sustain period. The sustain signal supplied to the sustain electrodes Z and the sustain signal supplied to the scan electrodes Y1 to Yn are alternately supplied.

The data driver 130 supplies a data signal to the address electrodes X1 to Xm during the address period. For instance, the data driver 130 may supply a video data signal input from the outside to the address electrodes X1 to Xm during the address period.

The data driver 130 supplies a rising signal gradually rising from a first voltage to a second voltage to the address electrodes X1 to Xm during a first sustain period; and a falling signal gradually falling from the second voltage to a third voltage to the address electrodes X1 to Xm during a second sustain period following the first sustain period.

The data driver 130 may supply a rising signal gradually rising from a first voltage to a second voltage to the address electrodes X1 to Xm during a first sustain period; a falling signal gradually falling from the second voltage to a fourth voltage to the address electrodes X1 to Xm during a second sustain period following the first sustain period; and a falling signal gradually falling from the fourth voltage to a third voltage to the address electrodes X1 to Xm during a third sustain period following the second sustain period.

The data driver 130 may include an energy recovery circuit for an operation of thereof.

The data driver 130 may gradually lower a voltage of the address electrodes X1 to Xm from the second voltage depending on a sustain load during the second sustain period; or may converge the voltage of the address electrodes X1 to Xm at the fourth voltage and then may gradually lower the voltage of the address electrodes X1 to Xm from the fourth voltage depending on a sustain load during the second and third sustain periods.

The sustain load is proportional to the number of discharge cells which are selected during an address period and emit light during a sustain period. In other words, as the number of discharge cells emitting light during the sustain period increases, the sustain load increases. When the sustain load increases, the voltage of the address electrodes X1 to Xm rapidly falls from the second voltage to the third voltage or converges at the fourth voltage and then rapidly falls from the fourth voltage to the third voltage during the second sustain period.

The above-described operation of the data driver 130 suppresses the generation of bright defects during the address period and suppresses an opposite discharge during the sustain period. The suppression of the opposite discharge prevents a damage to a phosphor, and thus life span of the plasma display panel increases.

Figure 2:
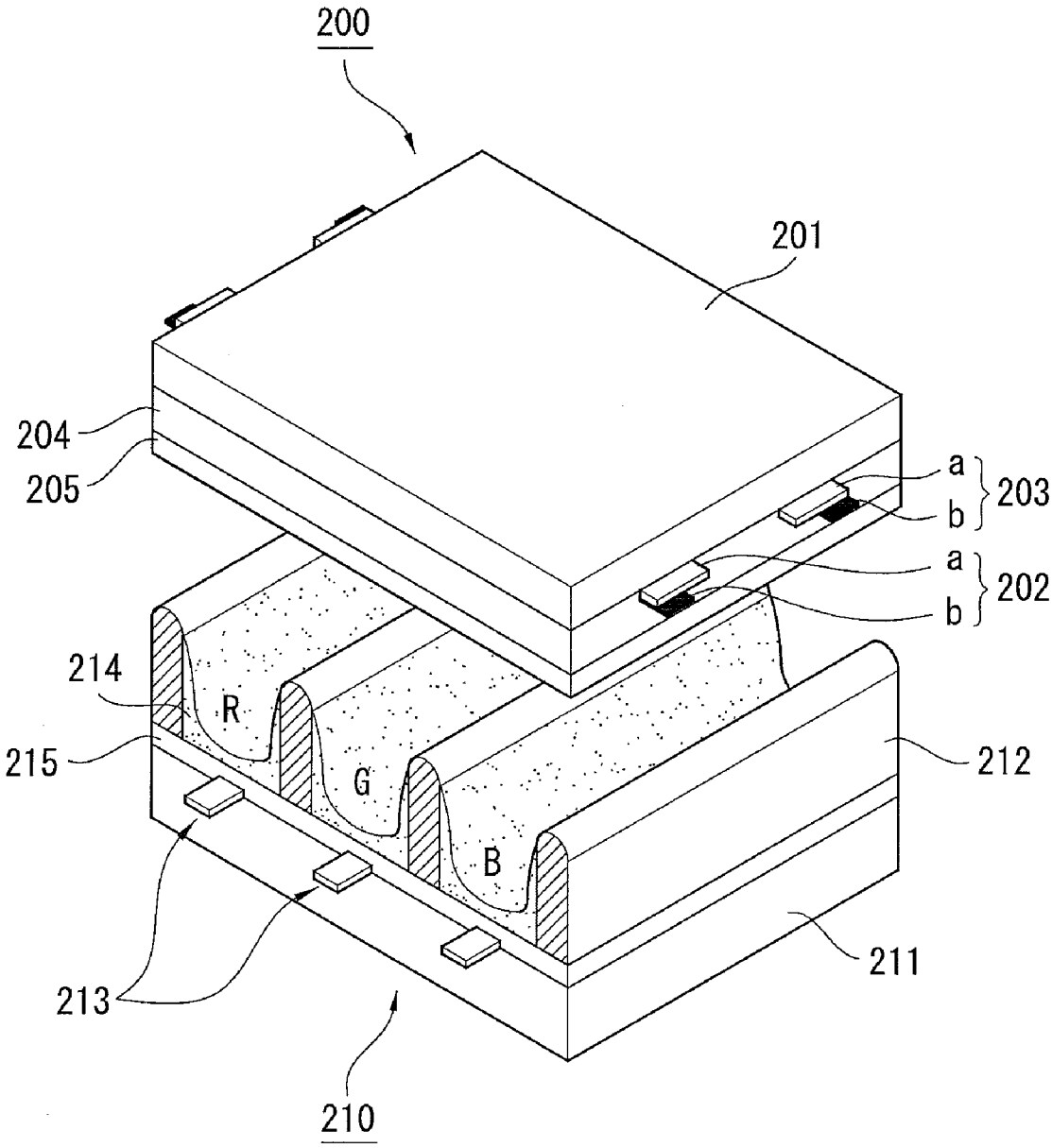
FIG. 2 illustrates a plasma display panel of FIG. 1.

As illustrated in FIG. 2, the plasma display panel 100 includes a front panel 200 and a rear panel 210 which are coupled in parallel to oppose to each other at a given distance therebetween. The front panel 200 includes a front substrate 201 being a display surface on which an image is displayed. The rear panel 210 includes a rear substrate 211 constituting a rear surface. A plurality of scan electrodes 202 and a plurality of sustain electrodes 203 are formed in pairs on the front substrate 201. A plurality of address electrodes 213 are arranged on the rear substrate 211 to intersect the scan electrodes 202 and the sustain electrodes 203.

The scan electrode 202 and the sustain electrode 203 each include transparent electrodes 202*a* and 203*a* made of a transparent material, for instance, indium-tin-oxide (ITO) and bus electrodes 202*b* and 203*b* made of a metal material. The scan electrode 202 and the sustain electrode 203 generate a mutual discharge therebetween in one discharge cell and maintain light-emissions of the discharge cells. The scan electrode 202 and the sustain electrode 203 are covered with one or more upper dielectric layers 204 for limiting a discharge current and providing electrical insulation between the scan electrode 202 and the sustain electrode 203. A protective layer 205 with a deposit of MgO is formed on an upper surface of the upper dielectric layer 204 to facilitate discharge conditions.

A plurality of stripe-type (or well-type) barrier ribs 212 are formed in parallel on the rear substrate 211 to form a plurality of discharge spaces (i.e., a plurality of discharge cells). The plurality of address electrodes 213 for performing an address discharge to generate vacuum ultraviolet rays are arranged in parallel to the barrier ribs 212. An upper surface of the rear substrate 211 is coated with red (R), green (G) and blue (B) phosphors 214 for emitting visible light for an image display during the generation of an address discharge. A lower dielectric layer 215 is formed between the address electrodes 213 and the phosphors 214 to protect the address electrodes 213.

FIG. 2 illustrated only an example of the plasma display panel 100. Accordingly, the exemplary embodiment is not limited to the structure of the plasma display panel illustrated in FIG. 2.

For instance, in FIG. 2, the scan electrode 202 and the sustain electrode 203 each include the transparent electrodes 202*a* and 203*a* and the bus electrodes 202*b* and 203*b*. However, at least one of the scan electrode 202 and the sustain electrode 203 may include only the bus electrode.

Further, in FIG. 2, the upper dielectric layer 204 has a constant thickness. However, the upper dielectric layer 204 may have a different thickness and a different dielectric constant in each area. The barrier ribs 212 have a constant interval between the barrier ribs. However, an interval between the barrier ribs 112 forming the blue discharge cell (B) may be larger than intervals between the barrier ribs 112 forming the red and green discharge cells (R and G).

Further, a luminance of an image displayed on the plasma display panel 100 can increase by forming the side of the barrier rib 112 in a concavo-convex shape and coating the phosphor 214 depending on the concavo-convex shape of the barrier rib 112.

A tunnel may be formed on the side of the barrier rib 112 so as to improve an exhaust characteristic when the plasma display panel is fabricated.

Figure 3:
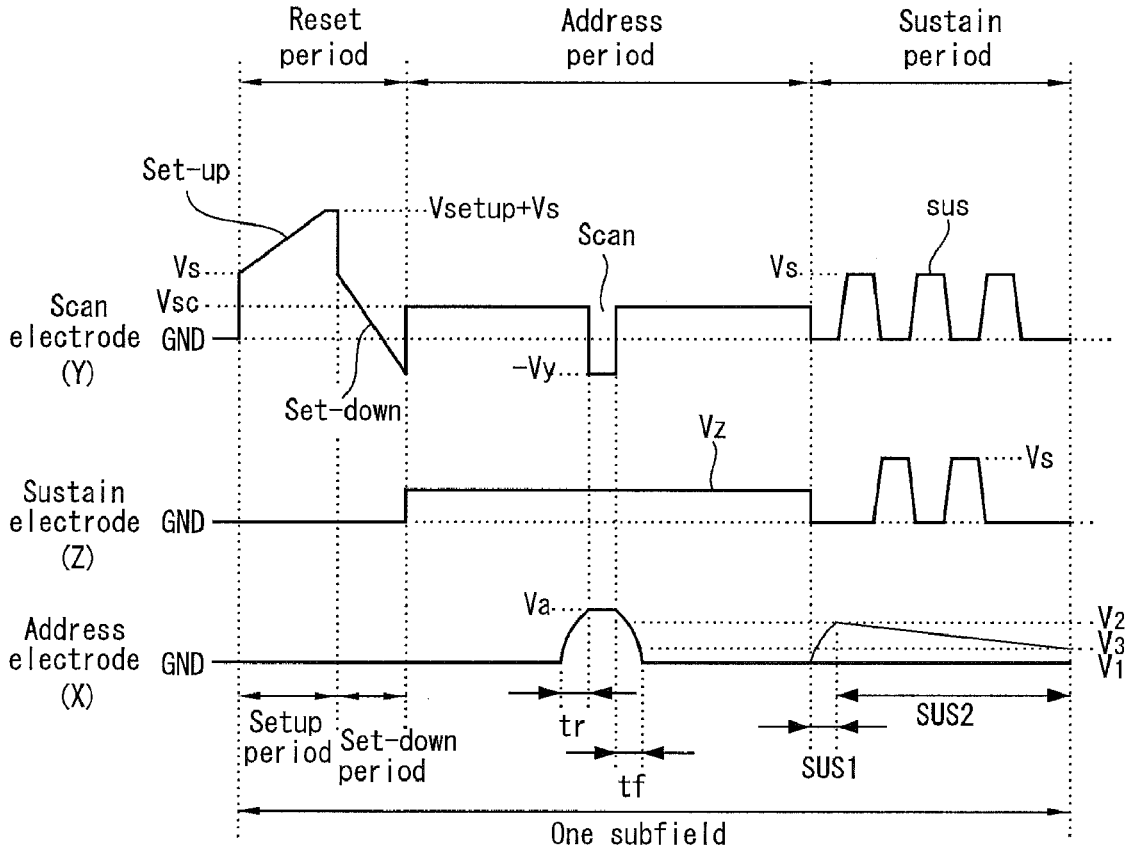
FIG. 3 illustrates an operation of the plasma display apparatus of FIG. 1.

As illustrated in FIG. 3, during a setup period of a reset period, the scan driver 110 of FIG. 1 may supply a setup signal (Set-up) to the scan electrode Y. The setup signal generates a weak dark discharge within the discharge cells of the whole screen. This results in wall charges of a positive polarity being accumulated on the sustain electrode Z and the address electrode X, and wall charges of a negative polarity being accumulated on the scan electrode Y.

During a set-down period of the reset period, the scan driver 110 may supply a set-down signal (Set-down) which falls from a positive voltage lower than a highest voltage of the setup signal (Set-up) to a given voltage level lower than a ground level voltage GND to the scan electrode Y, thereby generating a weak erase discharge within the discharge cells. Furthermore, the remaining wall charges are uniform inside the discharge cells to the extent that an address discharge can be stably performed.

In FIG. 3, both the setup signal (Set-up) and the set-down signal (Set-down) are supplied to the scan electrode Y during the reset period. However, only the set-down signal (Set-down) may be supplied during the reset period.

During an address period, the scan driver 110 may supply a scan reference voltage Vsc and a scan signal (Scan) falling from the scan reference voltage Vsc to the scan electrode Y. The data driver 130 may supply a data signal corresponding to the scan signal (Scan) to the address electrode X. As a voltage difference between the scan signal (Scan) and the data signal is added to a wall voltage produced during the reset period, an address discharge occurs within the discharge cells to which the data signal is supplied.

In FIG. 3, the scan driver 110 supplies the scan reference voltage Vsc during the address period. However, the scan driver 110 may supply a scan bias voltage (Vsc−Vy) equal to a sum of the scan reference voltage Vsc and a lowest voltage −Vy of the scan signal (Scan).

During a sustain period, the scan driver 110 and the sustain driver 120 may alternately supply sustain signals (sus) to the scan electrode Y and the sustain electrode Z. In FIG. 3, the sustain signals (sus) may be alternately supply to the scan electrode Y and the sustain electrode Z. However, some or all of the sustain signals (sus) supplied to the scan electrode Y and the sustain electrode Z may overlap each other.

As the wall voltage inside the discharge cells selected by performing the address discharge is added to the sustain signal (sus), every time the sustain signal (sus) is applied, a sustain discharge, i.e., a display discharge is generated between the scan electrode Y and the sustain electrode Z.

During a first sustain period SUS1 of the sustain period, the data driver 130 supplies a rising signal gradually rising from a first voltage V1 to a second voltage V2 to the address electrode X. During a second sustain period SUS2 of the sustain period, the data driver 130 supplies a falling signal gradually falling from the second voltage V2 to a third voltage V3 to the address electrode X. The first voltage V1 and the third voltage V3 may be higher than a ground level voltage GND.

An opposite discharge generated between the address electrode X and the scan electrode Y or the sustain electrode Z during the sustain period can be suppressed due to the supplying of the rising signal and the falling signal. The suppression of the opposite discharge prevents a damage to a phosphor, and thus life span of the plasma display panel increases.

Figure 4:
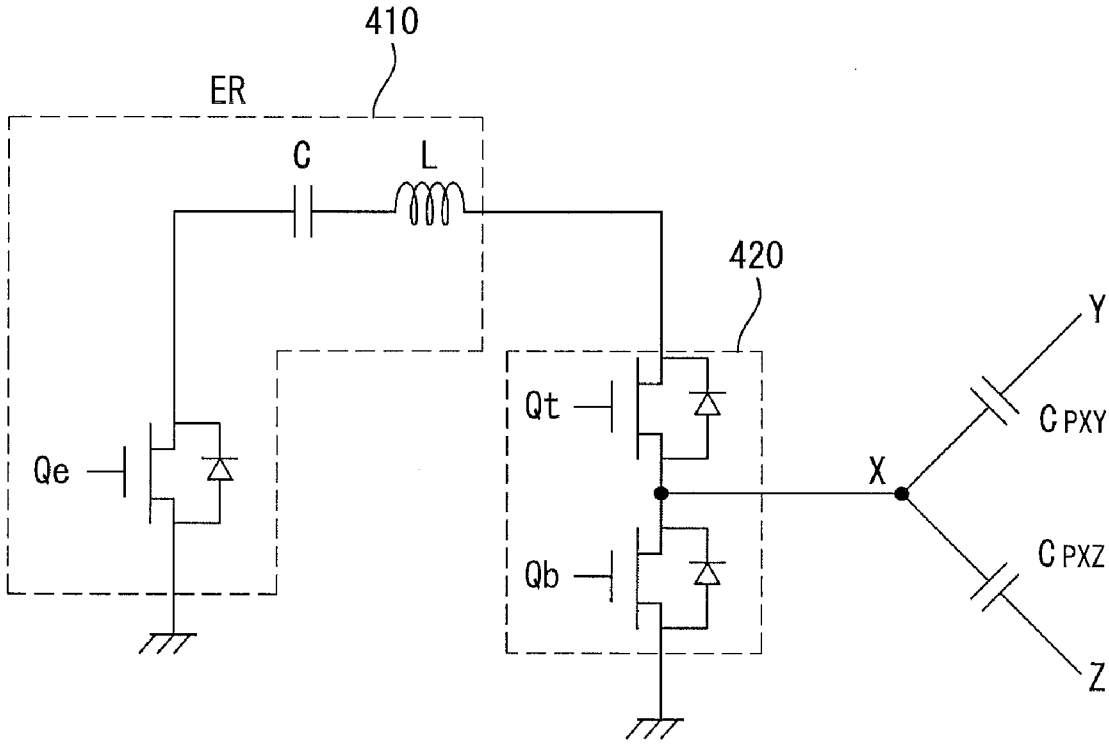
FIG. 4 illustrates a data driver of FIG. 1.

The first voltage V1 may be substantially equal to the ground level voltage GND. The second voltage V2 may be lower than a data voltage Va supplied to the address electrode X during the address period. As illustrated in FIG. 4, an energy recovery circuit 410 included in the data driver 130 may supply the second voltage V2 lower than the data voltage Va.

A capacitor C of the energy recovery circuit 410 is charged to a voltage Va/2 corresponding to one half of the data voltage Va. A voltage of the address electrode X gradually rises from the first voltage V1 through resonance between an inductor L and equivalent capacitors $C_{PXY}$ and $C_{PXZ}$ of the plasma display panel during the first sustain period SUS1. Because a resonance control switch Qe is turned off before the voltage of the address electrode X reaches the data voltage Va, the voltage of the address electrode X rises to the second voltage V2 lower than the data voltage Va.

If the voltage of the address electrode X rises to the data voltage Va, wall charges of a negative polarity are excessively accumulated on the address electrode X. Hence, an address discharge occurs without the supplying of the data voltage Va during an address period of a next subfield. This results in the generation of bright defects. Therefore, when the second voltage V2 is lower than the data voltage Va, the generation of bright defects is prevented while an opposite discharge is suppressed.

As illustrated in FIG. 3, during the second sustain period SUS2, the voltage of the address electrode X gradually falls from the second voltage V2 to the third voltage V3.

Since the data driver 130 floats the address electrode X after the energy recovery circuit 410 raise the voltage of the address electrode X to the second voltage V2, the voltage of the address electrode X gradually falls from the second voltage V2 due to the display discharge generated inside the discharge cell. In other words, the data driver 130 supplies the falling signal to the address electrode X by floating the address electrode X.

The supplying of the data signal is performed by the energy recovery circuit 410. Therefore, a first voltage change ratio of a magnitude of a voltage difference between the first voltage V1 and the second voltage V2 to a time width (duration) of the first sustain period SUS1 may be substantially equal to a voltage change ratio of a magnitude of a voltage difference between the ground level voltage GND and the data voltage Va to a time width of a rising period tr of FIG. 3. The rising period tr is time required to raise the voltage of the address electrode X from the ground level voltage GND to the data voltage Va. Accordingly, the data driver 130 can supply the rising signal during the first sustain period SUS1 without a separate circuit.

Further, a second voltage change ratio of a magnitude of a voltage difference between the second voltage V2 and the third voltage V3 to a time width of the second sustain period SUS2 may be smaller than a voltage change ratio of a magnitude of a voltage difference between the data voltage Va and the ground level voltage GND to a time width of a falling period tf of FIG. 3. The falling period tf is time required to lower the voltage of the address electrode X from the data voltage Va to the ground level voltage GND.

The reason why the second voltage change ratio is smaller than the voltage change ratio of the data signal is that while the data signal is produced by resonance between the inductor L and the capacitor C of the energy recovery circuit 410, the second voltage change ratio changes depending on the sustain load. In other words, a level of the third voltage V3 may change depending on the sustain load. If a display discharge occurs using a small number of discharge cells during a sustain period, the voltage difference between the second voltage V2 and the third voltage V3 is small. If a display discharge occurs using a large number of discharge cells during a sustain period, the voltage difference between the second voltage V2 and the third voltage V3 is large.

The data driver of FIG. 4 includes the energy recovery circuit 410 and a data drive integrated circuit (IC) 420. In FIG. 4, $C_{PXY}$ indicates an equivalent capacitor between the address electrode X and the scan electrode Y, and $C_{PXZ}$ indicates an equivalent capacitor between the address electrode X and the sustain electrode Z.

The energy recovery circuit 410 includes the capacitor C charged to one half Va/2 of the data voltage Va, the inductor L for resonance, and the resonance control switch Qe for the control of the resonance formation.

The data drive IC 420 includes a top switch Qt and a bottom switch Qb connected to the address electrode X.

In FIG. 4, the data drive IC 420 is connected to the address electrode X. However, the inductor L may be connected to the address electrode X.

Figure 5:
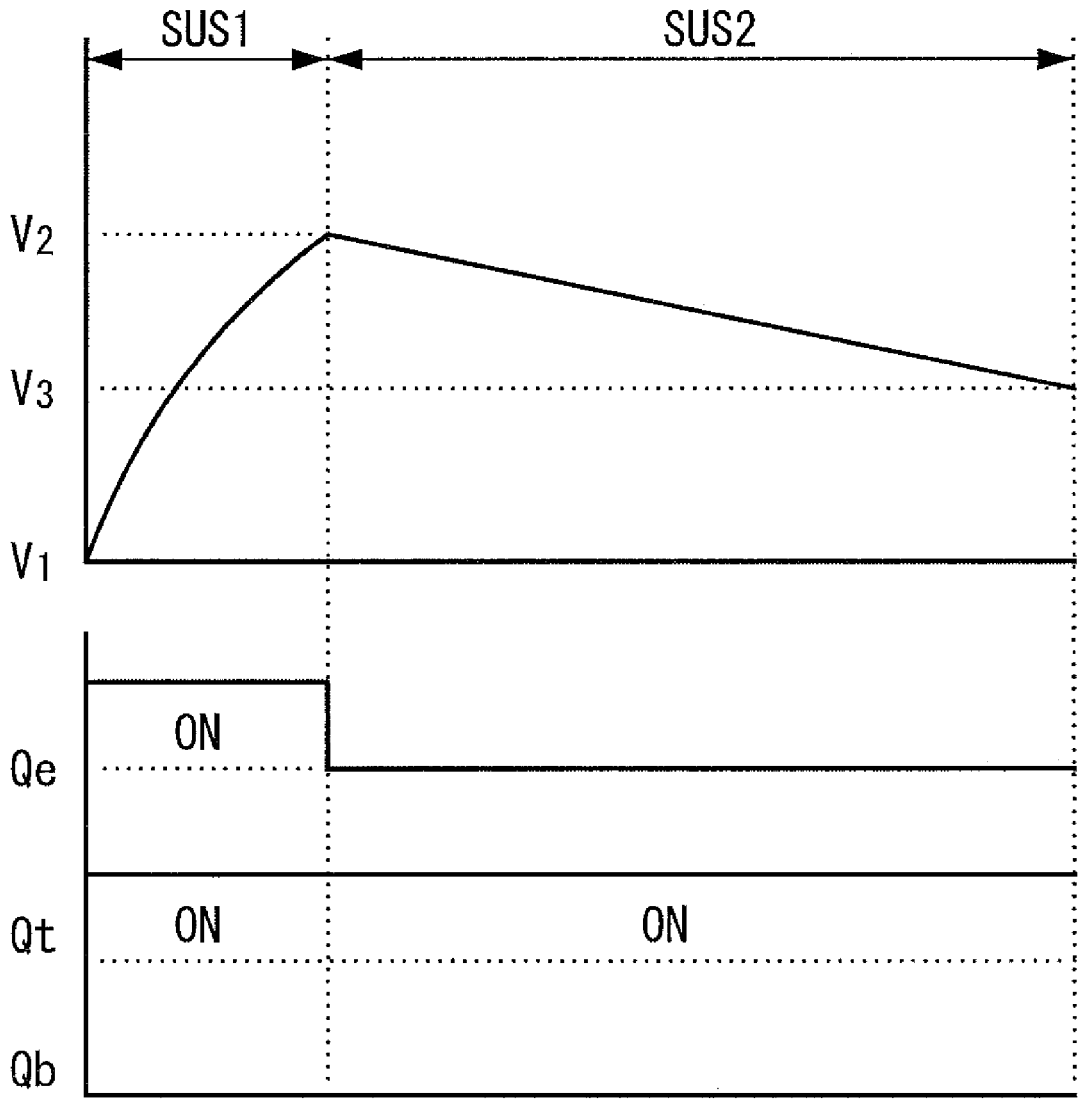
FIG. 5 illustrates a method of driving the data driver of FIG. 4.
Figure 6:
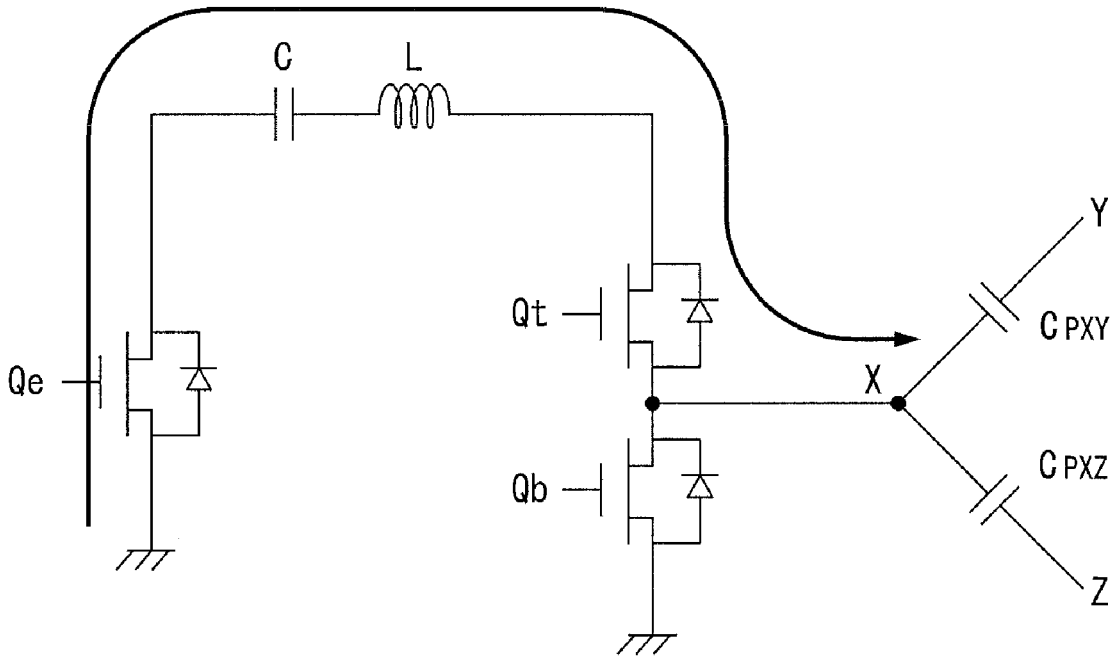
FIGS. 6 and 7 illustrate an operation of the data driver depending on the driving method of FIG. 5.

As illustrated in FIG. 5, the resonance control switch Qe and the top switch Qt are turned on during the first sustain period SUS1 of FIG. 3. Hence, a current path illustrated in FIG. 6 is formed. In other words, the capacitor C is discharged due to the turned-on resonance control switch Qe, and the inductor L and the equivalent capacitors $C_{PXY}$ and $C_{PXZ}$ form series resonance. The voltage of the address electrode X gradually rises from the first voltage V1 to the second voltage V2. Since the capacitor C is charged to one half Va/2 of the data voltage Va, the resonance control switch Qe is turned off before the voltage of the address electrode X rises to the data voltage Va.

Figure 7:
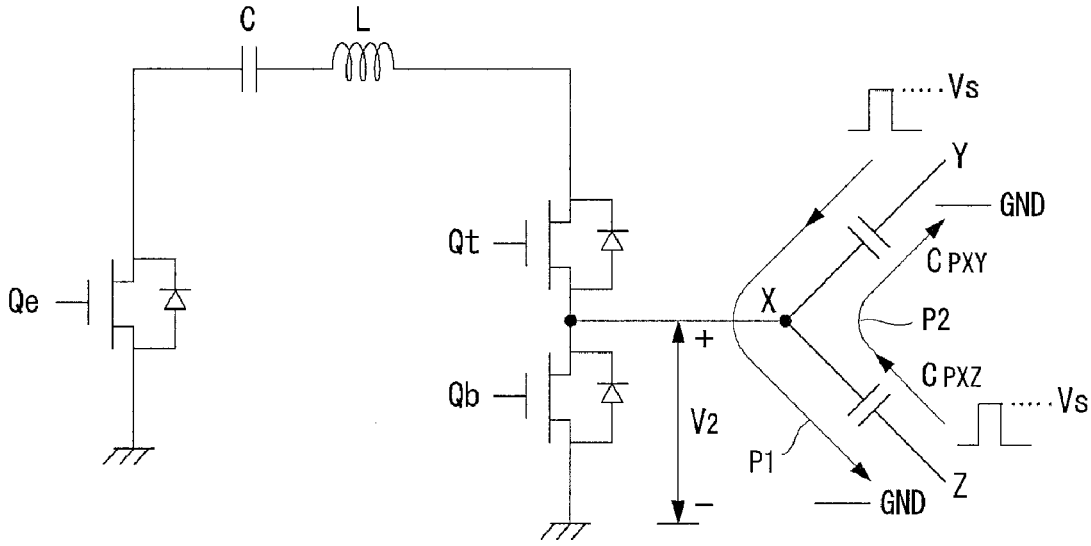

The resonance control switch Qe is turned off and the top switch Qt is maintained in a turn-on state during the second sustain period SUS2 of FIG. 3. Hence, as illustrated in FIG. 7, the address electrode X is floated. When the address electrode X is floated and the sustain signal rising to the sustain voltage Vs and the ground level voltage GND are supplied to the scan electrode Y and the sustain electrode Z, respectively, a current path P1 is formed. Further, when the address electrode X is floated and the ground level voltage GND and the sustain signal rising to the sustain voltage Vs are supplied to the scan electrode Y and the sustain electrode Z, respectively, a current path P2 is formed.

Since some of charges charged to the address electrode X flows into the scan electrode Y or the sustain electrode Z through the equivalent capacitor $C_{PXY}$ or $C_{PXZ}$ along the current paths P1 and P2, the voltage of the address electrode X gradually falls from the second voltage V2 to the third voltage V3. Accordingly, the data driver 130 can supply the fall signal to the address electrode X during the second sustain period SUS2 without a separate circuit by floating the address electrode X, thereby suppressing an opposite discharge.

The second voltage change ratio is proportional to the number of discharge cells from which light is emitted. For instance, when a sustain load is large (i.e., when light is emitted from a large number of discharge cells), the number of discharge cells, into which a current flows, increases. Therefore, a line resistance of each of the scan electrode Y and the sustain electrode Z increases, and also the second voltage change ratio increases during the second sustain period SUS2. On the contrary, when light is emitted from a small number of discharge cells, the number of discharge cells, into which a current flows, decreases. Therefore, a line resistance of each of the scan electrode Y and the sustain electrode Z decreases, and also the second voltage change ratio decreases during the second sustain period SUS2.

The second voltage charge ratio during the second sustain period SUS2 is smaller than the first voltage charge ratio during the first sustain period SUS1.

The reason why the second voltage charge ratio is smaller than the first voltage charge ratio is that while changes in the voltage of the address electrode X during the first sustain period SUS1 is performed by the energy recovery circuit 410, changes in the voltage of the address electrode X during the second sustain period SUS2 is performed by a discharge of the equivalent capacitor due to the floating of the address electrode X.

Figure 8:
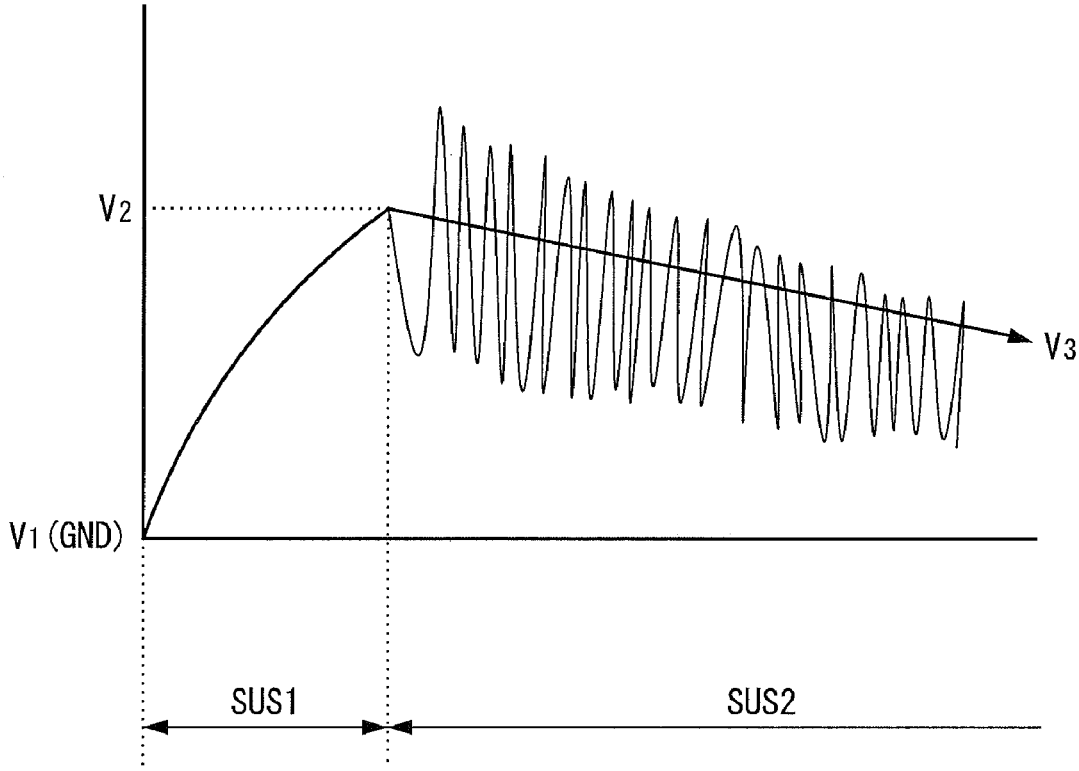
FIG. 8 illustrates changes in a voltage of an address electrode depending on the operation of the data driver of FIGS. 6 and 7.

Although it is not shown, to stably drive the plasma display panel during a reset period of a next subfield, the bottom switch Qb of the data driver is turned on at a time when the sustain period ends. Hence, the voltage of the address electrode falls to the ground level voltage GND As illustrated in FIG. 8, the resonance control switch Qe and the top switch Qt are turned on during the first sustain period SUS1. Hence, the voltage of the address electrode X gradually rises from the first voltage V1 substantially equal to the ground level voltage GND to the second voltage V2 lower than the data voltage Va due to resonance between the inductor L and the equivalent capacitors $C_{PXY}$ and $C_{PXZ}$ during the first sustain period SUS1.

Afterwards, the resonance control switch Qe is turned off and the top switch Qt is maintained in a turn-on state during the second sustain period SUS2. Hence, the address electrode X is floated, and the voltage of the address electrode X gradually falls from the second voltage V2 to the third voltage V3 depending on the sustain load.

Figure 9:
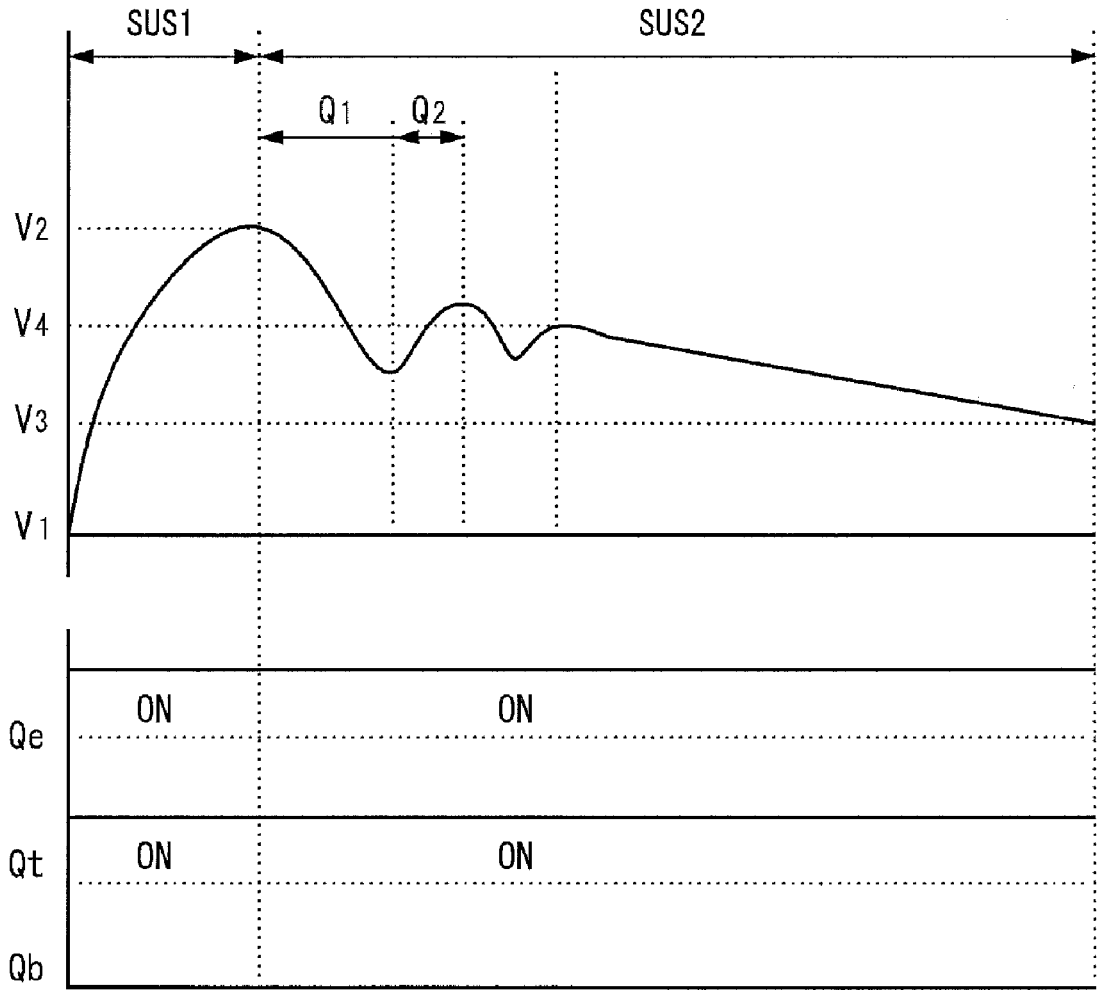
FIG. 9 illustrates another method of driving the data driver of FIG. 4.

As illustrated in FIG. 9, the first voltage change ratio of the address electrode X during the first sustain period SUS1 is substantially equal to a rising slope of the data signal supplied to the address electrode X during the address period. The reason is that the rising of the data signal is performed due to resonance between the inductor L and the equivalent capacitors $C_{PXY}$ and $C_{PXZ}$ when the resonance control switch Qe and the top switch Qt are turned on. A switching timing diagram of FIG. 9 is different from a switching timing diagram of FIG. 5 in that the resonance control switch Qe and the top switch Qt are continuously maintained in a turn-on state during the first sustain period SUS1 and the second sustain period SUS2.

Hence, the capacitor C supplies the voltage Va/2 to the address electrode X, and resonance occurs between the inductor L and the equivalent capacitors $C_{PXY}$ and $C_{PXZ}$. The voltage of the address electrode X gradually rises from the first voltage V1 to the second voltage V2 during the first sustain period SUS1.

Since the resonance control switch Qe and the top switch Qt are continuously maintained in a turn-on state during periods Q1 and Q2 of the second sustain period SUS2, the falling and the rising of the voltage of the address electrode X are repeated and then the voltage of the address electrode X gradually falls.

Since the resonance control switch Qe and the top switch Qt are continuously maintained in a turn-on state after the periods Q1 and Q2, the voltage of the address electrode X gradually falls to the third voltage V3.

The second voltage change ratio of the address electrode X during the second sustain period SUS2 may be smaller than the voltage change ratio of the data signal during the falling period tf of FIG. 3. The voltage of the address electrode X converges at a fourth voltage V4 after the periods Q1 and Q2. A magnitude of the fourth voltage V4 is approximately equal a magnitude of a voltage charged to both terminals of the capacitor C of FIG. 10.

While the falling and the rising of the voltage of the address electrode X are repeated during the second sustain period SUS2, the voltage of the address electrode X converges at the fourth voltage V4. Hence, the voltage of the address electrode X enters a stable state. The reason is that the voltage of the address electrode X goes through a transient state and then finally converges at the fourth voltage V4 charged to both terminals of the capacitor C depending on the inductor L and the capacitor C of the energy recovery circuit 410, conductive lines of the energy recovery circuit 410, a resistance existing on the plasma display panel, and the equivalent capacitors CPXY and CPXZ.

Figure 10:
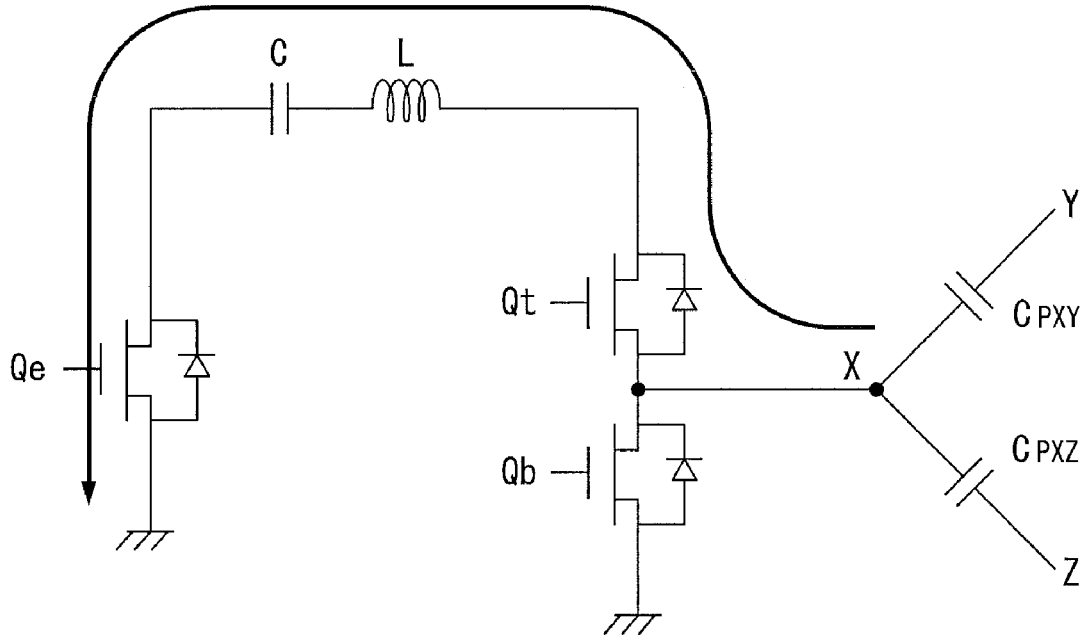
FIGS. 10 and 11 illustrate an operation of the data driver depending on the driving method of FIG. 9.
Figure 11:
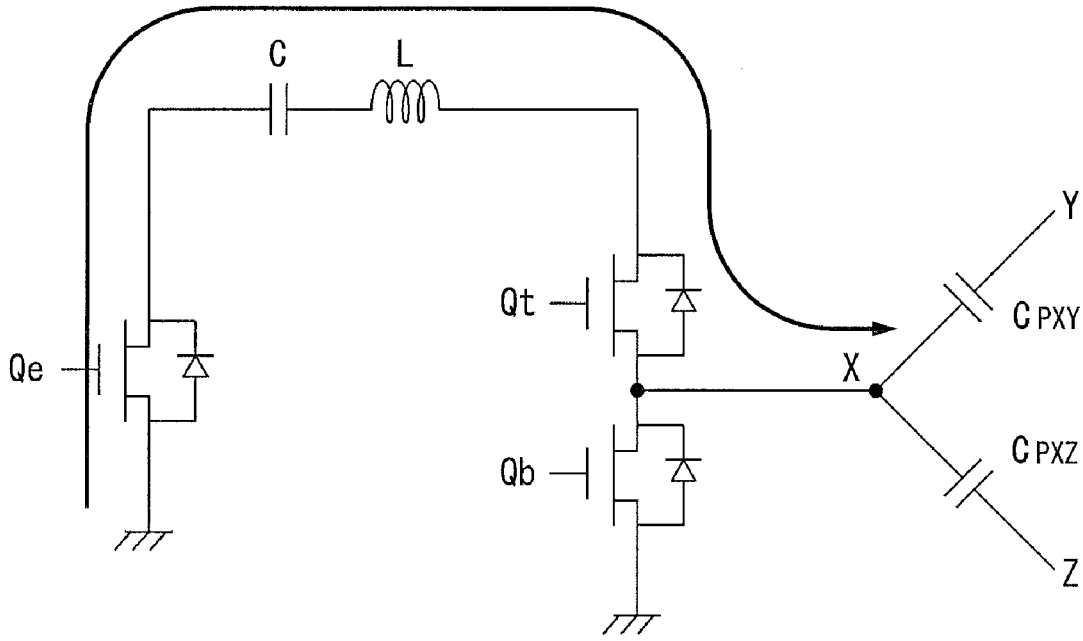

As illustrated in FIG. 10, since a direction of a current flowing into the inductor L of the energy recovery circuit 410 changes in the opposite direction during the period Q1 of the second sustain period SUS2, the voltage of the address electrode X falls. As illustrated in FIG. 11, since a direction of a current flowing into the inductor L of the energy recovery circuit 410 changes again in during the period Q2 of the second sustain period SUS2, the voltage of the address electrode X rises. As predetermined time elapses, the falling width and the rising width of the voltage of the address electrode X gradually decrease and the voltage of the address electrode X converges at the fourth voltage V4.

Changes in the voltage of the address electrode X during the first sustain period SUS1 occurs due to the turned-on resonance control switch Qe, and changes in the voltage of the address electrode X during the second sustain period SUS2 occurs by maintaining the resonance control switch Qe in a turn-on state. Since the rising and the falling of the voltage of the address electrode X are repeated during the second sustain period SUS2 as illustrated in FIGS. 10 and 11, it takes a lot of time to converge the voltage of the address electrode X at the fourth voltage V4. Accordingly, the second voltage change ratio of the address electrode X during the second sustain period SUS2 is smaller than the first voltage change ratio of the address electrode X during the first sustain period SUS1.

After the periods Q1 and Q2, the voltage of the address electrode X gradually falls from the fourth voltage V4 to the third voltage V3 higher than the ground level voltage depending on the sustain load. Accordingly, since the voltage of the address electrode X is lower than the data voltage Va during the sustain period, wall charges of a negative polarity are not excessively accumulated on the address electrode X. Hence, bright defects and an opposite discharge can be suppressed.

Figure 12:
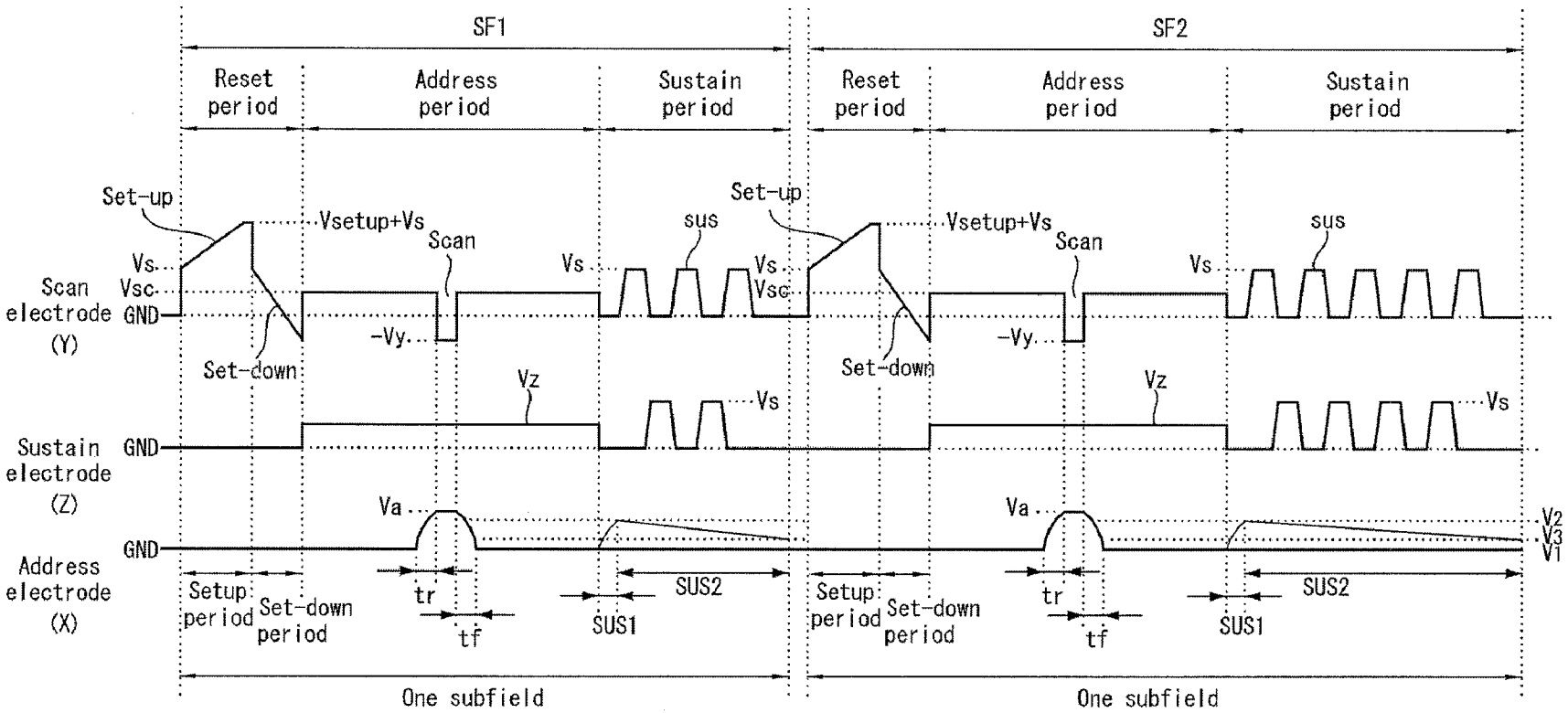
FIG. 12 illustrates an operation of the plasma display apparatus of FIG. 1 during first and second subfields.

As illustrated in FIG. 12, the plasma display apparatus according to the exemplary embodiment can supply falling signal each having a different second voltage change ratio during a first subfield SF1 and a second subfield SF2. The number of sustain signals assigned to the first subfield SF1 is less than the number of sustain signals assigned to the second subfield SF2. In FIG. 12, the first subfield SF1 and the second subfield SF2 are sequentially positioned. However, the first subfield SF1 and the second subfield SF2 may not be sequentially positioned.

The data driver 101 of FIG. 1 supplies rising signals and falling signals during the first subfield SF1 to which m sustain signals are assigned and the second subfield SF2 to which n (where m<n) sustain signals are assigned. The data driver 101 supplies the falling signals during the first and second subfields SF1 and SF2 by floating the address electrode X.

Since the number of sustain signals assigned to the second subfield SF2 is more than the number of sustain signals assigned to the first subfield SF1, the number of current paths P1 and P2 of FIG. 7 in the second subfield SF2 is more than the number of current paths P1 and P2 of FIG. 7 in the first subfield SF1.

In other words, since the current path P1 or P2 is formed whenever one sustain signal is supplied, the formation number of current path P1 or P2 increases by increasing the number of sustain signals. Since wall charges accumulated on the address electrode X are rapidly discharged when the formation number of current path P1 or P2 increases, the second voltage change ratio of the falling signal increases.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including an address electrode;

wherein a sustain period consists of a first sustain period and a second sustain period; and a data driver that supplies a rising signal gradually rising from a first voltage to a second voltage to the address electrode during the first sustain period and a falling signal gradually falling from the second voltage to a third voltage, without rising, to the address electrode during the second sustain period following the first sustain period.

2. The plasma display apparatus of claim 1, wherein a second voltage change ratio of a magnitude of a voltage difference between the second voltage and the third voltage to a time width of the second sustain period is smaller than a first voltage change ratio of a magnitude of a voltage difference between the first voltage and the second voltage to a time width of the first sustain period.

3. The plasma display apparatus of claim 1, wherein the data driver floats the address electrode during the second sustain period.

4. The plasma display apparatus of claim 1, wherein a first voltage change ratio of a magnitude of a voltage difference between the first voltage and the second voltage to a time width of the first sustain period is substantially equal to a voltage change ratio of a magnitude of a voltage difference between a ground level voltage and a data voltage to a time width of a rising period required to raise a voltage of the address electrode from the ground level voltage to the data voltage.

5. The plasma display apparatus of claim 1, wherein a second voltage change ratio of a magnitude of a voltage difference between the second voltage and the third voltage to a time width of the second sustain period is smaller than a voltage change ratio of a magnitude of a voltage difference between a data voltage and a ground level voltage to a time width of a falling period required to lower a voltage of the address electrode from the data voltage to the ground level voltage.

6. The plasma display apparatus of claim 1, wherein the first voltage is higher than a ground level voltage.

7. The plasma display apparatus of claim 1, wherein the second voltage is lower than a highest voltage of a data signal supplied to the address electrode during an address period.

8. The plasma display apparatus of claim 1, wherein the third voltage is higher than a ground level voltage.

9. The plasma display apparatus of claim 1, wherein the data driver includes an inductor and a capacitor, and the rising signal is produced by resonance between the inductor and the capacitor.

10. The plasma display apparatus of claim 1, wherein the data driver includes a switch, an inductor and a capacitor connected to one another in series, and the switch is maintained in a turn-on state during the first sustain period the second sustain period.

11. The plasma display apparatus of claim 2, wherein the second voltage change ratio is proportional to the number of discharge cells from which light is emitted.

12. The plasma display apparatus of claim 2, wherein the data driver supplies the rising signal and the falling signal during a first subfield to which m sustain signals are assigned and a second subfield to which n (where m<n) sustain signals are assigned, and a second voltage change ratio of the falling signal supplied during the second subfield is larger than a second voltage change ratio of the falling signal supplied during the first subfield.

13. A method of driving a plasma display apparatus including an address electrode comprising:

wherein a sustain period consists of a first sustain period and a second sustain period;

supplying a rising signal gradually rising from a first voltage to a second voltage to the address electrode during the first sustain period; and supplying a falling signal gradually falling from the second voltage to a third voltage, without rising, to the address electrode during the second sustain period following the first sustain period.

14. The method of claim 13, wherein a second voltage change ratio of a magnitude of a voltage difference between the second voltage and the third voltage to a time width of the second sustain period is smaller than a first voltage change ratio of a magnitude of a voltage difference between the first voltage and the second voltage to a time width of the first sustain period.

15. The method of claim 13, wherein the address electrode is floated during the second sustain period.

16. The method of claim 13, wherein a first voltage change ratio of a magnitude of a voltage difference between the first voltage and the second voltage to a time width of the first sustain period is substantially equal to a voltage change ratio of a magnitude of a voltage difference between a ground level voltage and a data voltage to a time width of a rising period required to raise a voltage of the address electrode from the ground level voltage to the data voltage.

17. The method of claim 13, wherein a second voltage change ratio of a magnitude of a voltage difference between the second voltage and the third voltage to a time width of the second sustain period is smaller than a voltage change ratio of a magnitude of a voltage difference between a data voltage and a ground level voltage to a time width of a falling period required to lower a voltage of the address electrode from the data voltage to the ground level voltage.

18. The method of claim 14, wherein the second voltage change ratio is proportional to the number of discharge cells from which light is emitted.

19. The method of claim 14, wherein the rising signal and the falling signal are supplied during a first subfield to which m sustain signals are assigned and a second subfield to which n (where m<n) sustain signals are assigned, and a second voltage change ratio of the falling signal supplied during the second subfield is larger than a second voltage change ratio of the falling signal supplied during the first subfield.

* * * * *